United States Patent [19]

Ahmann

[11] Patent Number: 4,854,652

[45] Date of Patent: Aug. 8, 1989

[54] DUAL VOTING BOOTH PACKAGE

[76] Inventor: John E. Ahmann, 1400 Duhig Rd., Napa, Calif. 94558

[21] Appl. No.: 192,945

[22] Filed: May 12, 1988

[51] Int. Cl.[4] ..... A47B 96/18

[52] U.S. Cl. ..... 312/140.2; 108/41; 312/244; 312/258

[58] Field of Search ..... 312/258, 259, 262, 231, 312/239, 223, 6, 140.2, 140.3, 140.4, 294; 108/41, 60

[56] References Cited

U.S. PATENT DOCUMENTS

| | | | |
|---|---|---|---|
| 3,333,766 | 8/1967 | Crossland et al. | 312/258 X |
| 3,389,947 | 6/1968 | Kelley et al. | 312/6 X |
| 3,550,540 | 12/1970 | Albrecht et al. | 312/258 X |
| 3,620,587 | 11/1971 | Ahmann | 312/258 X |
| 3,806,219 | 4/1974 | Ahmann | 312/223 |
| 4,451,728 | 5/1984 | McKay et al. | 312/258 X |
| 4,484,787 | 11/1984 | Stephens | 108/60 X |
| 4,660,904 | 4/1987 | Stephens | 312/258 X |

*Primary Examiner*—Peter A. Aschenbrenner
*Assistant Examiner*—Thomas A. Rendos
*Attorney, Agent, or Firm*—Owen, Wickersham & Erickson

[57] ABSTRACT

A pair of portable self contained voting booths comprised of main base members which fit together to form a compact carrying case for all of the other components of the two booths including support legs and foldable privacy shields. Each base member has corner sockets for receiving the support legs from below and a recessed central portion that provides storage space for the support legs and shield, when the base members are held together by removable clips in their storage and transporting mode. When erected for use, the base members are separated by release of the clips so that, the support legs and privacy shields for both booths can be quickly installed and set up to provide two voting stations.

14 Claims, 4 Drawing Sheets

DUAL VOTING BOOTH PACKAGE

This invention relates to voting booths and more particularly to an improved portable voting booth which is self contained when disassembled and forms a compact package without the use of boxes or other packaging.

BACKGROUND OF THE INVENTION

Since voting booths are used at certain time spaced intervals, it is important that they be as compact as possible to minimize storage requirements. Also, when it becomes necessary to remove such booths from storage, it is desireable that they be easily erectable for normal use by unskilled labor and without the need for special tools.

Heretofore, various forms of portable voting booths have been devised which utilize a transportable container such as a suitcase or box having a lid within which components for a single booth are retained. When erected for use, the suitcase provided a single voting booth with the necessary privacy shield, working area and support legs. One example of prior art portable voting booths is shown in my previous U.S. Pat. No. 4,445,731 which discloses a single booth assembly that incorporates a case within which collapsible legs suitcase like carrying case within which collapsible legs and shield members are stored. Generally, the aforesaid carrying case was made of a light metal such as aluminum. Other examples of prior art voting booths are shown in U.S. Pat. Nos. 3,333,766, 3,389,947, 3,620,587, and 3,806,219.

A general object of the present invention is to provide a portable voting booth that is even lighter, more compact and therefore consumes less storage space than portable voting booths heretofore devised.

Another more specific object of the invention is to provide a portable voting booth structure comprised of a pair of base components that fit together when stored to form a relatively compact suitcase-like package containing the necessary secondary booth components and which can be erected to form a pair of voting booths.

Still another object of the invention is to provide a pair of voting booths which in knockdown form can form a single package that is light, easy to hand carry and also capable of being stacked compactly in nested order for storage in a relatively small amount of space.

Yet another object of the present invention is to provide an improved voting booth that is particularly well adapted for ease and economy of manufacture.

SUMMARY OF THE INVENTION

In accordance with the principles of the invention, the aforesaid objects are accomplished by the provision of a pair of identical base members which can be connected together to form a suitcase-like package containing all of the necessary components for two portable voting booths. Each base member is a one-piece molded plastic structure having sidewalls, endwalls, a central portion forming a recessed area and four leg receiving sockets. In storage, the connected pair of base members are held together by removable retaining clips, and the recessed area for each base member provides a space within the package that accommodates a set of folded support legs and a folded privacy screen held in place by elastomeric bungee cords. When the voting booths are to be erected, the retaining clips are released to separate the two base members. The support legs for each base member are inserted into the receptacle sockets, and the privacy shield is attached to the central area of its base member and held in place by the bungee cords.

The assembly and disassembly of the voting booths can be accomplished with unusual speed and efficiency and when not in use, the packages comprising pairs of voting booths can be stacked for storage with minimal space requirements.

Other objects, advantages and features of the present invention will become apparent from the following detailed description of one embodiment thereof, presented in conjunction with the acompanying drawing.

DETAILED DESCRIPTION OF EMBODIMENT

Figure 1:
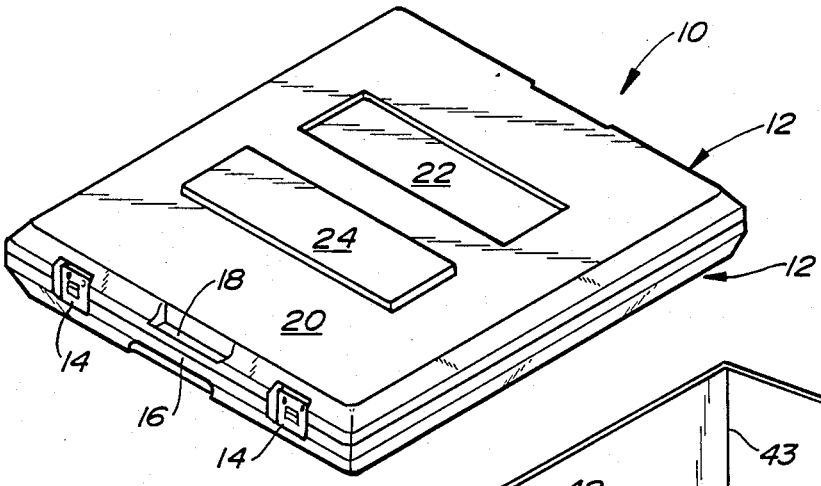
FIG. 1 is a view in perspective of a pair of voting booth base members held together to form a self-contained carrying package in accordance with the principles of the present invention.
Figure 3:
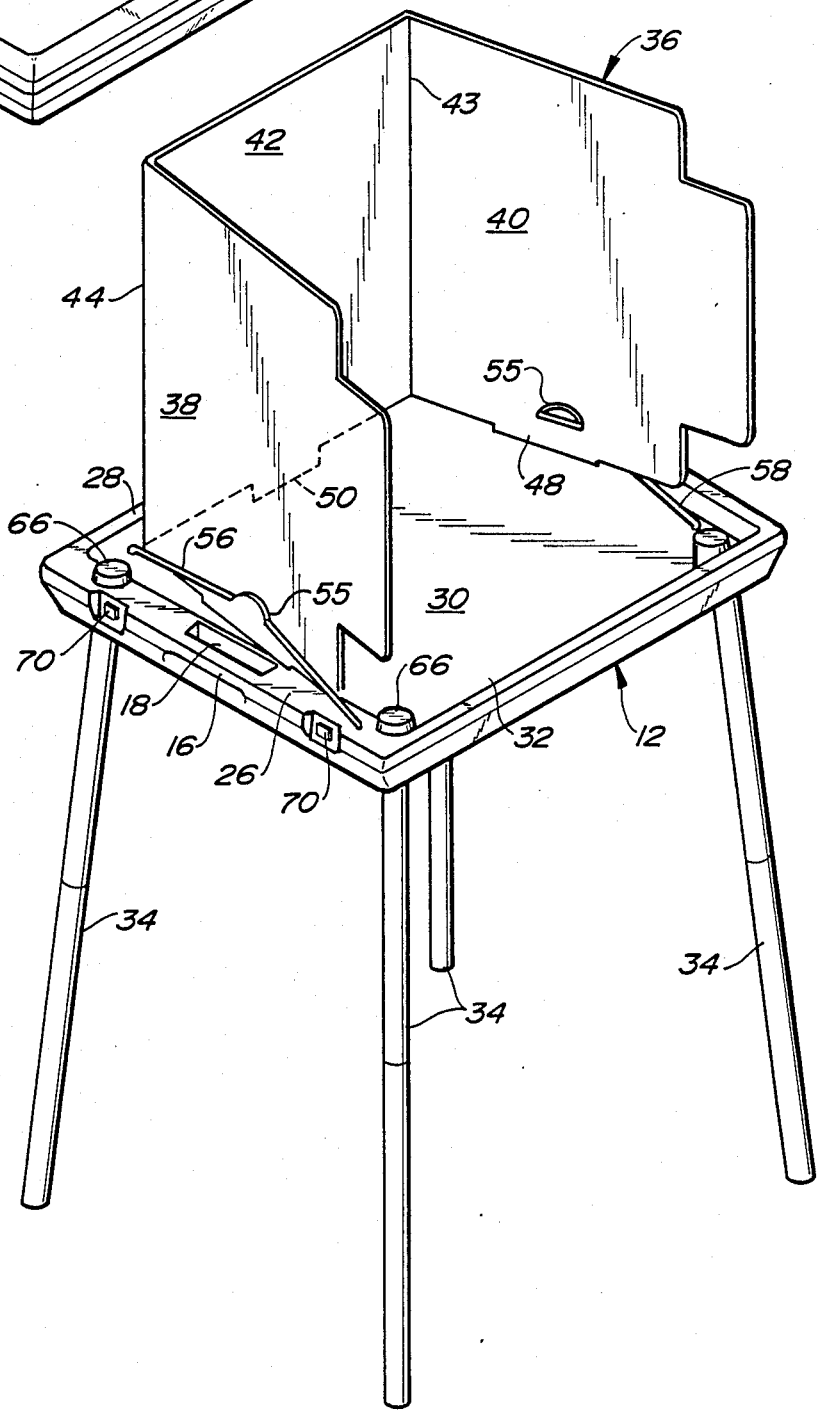
FIG. 3 is a view in perspective showing one voting booth from the package of FIGS. 1 and 2 as it appears when fully erected an for use.

With reference to the drawing, FIG. 1 shows a suitcase-like package 10 comprised of a pair of identical voting booth base members 12 in accordance with the invention. The two base members are held together at opposite ends by a series of retaining clips 14 which can be readily manipulated to separate the base members. Between the clips at both ends, each base member has an edge portion forming a handle member 16 adjacent an opening 18 so that a person can readily grip and carry the dual voting booth package 10. On the outer surface 20 of each base member (and thus on both sides of the package) are a pair of spaced apart, elongated and rectangular shaped surface members 22 and 24 that serve to facilitate the nesting and orderly stacking of a plurality of voting booth packages 10 for storage. The surface member 22 is recessed slightly below the surrounding outer surface 20 and the surface member 24 extends above the surrounding outer surface. Also, the member 22 has a perimeter that is slightly larger in length and width than the perimeter of the surface member 24 so that when a plurality of packages 10 are stacked, the raised member 24 of one package will fit within the recessed member 22 of an adjacent package, thereby maintaining the stacking alignment of a plurality of packages.

Figure 2:
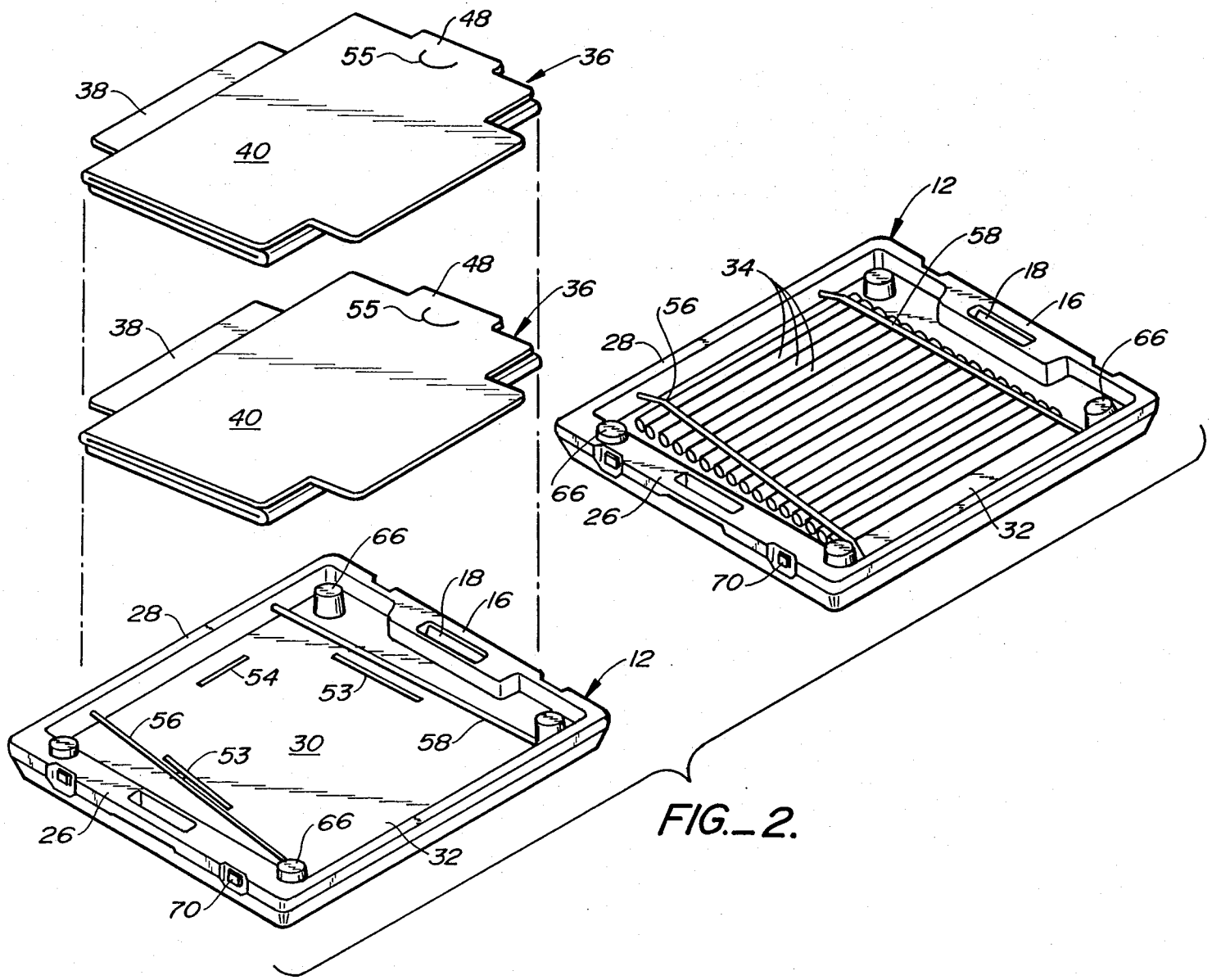
FIG. 2 is an exploded view in perspective of the dual voting booth package shown in FIG. 1.

As shown in FIG. 2, each base member 12 is generally rectangular shaped and has connecting side wall and end wall portions 26 and 28 that extend above a central portion 30 having the outer surface 20.

When the base member 12 is oriented so that its outer surface 20 is its underide and is supported from below, its wall portions 26 and 28 around the center portion form a generally recessed area 32. This recessed area of each base member provides a storage space for other components of a single voting booth, namely a set of four collapsible support legs 34 and a foldable privacy shield 36.

Each support leg may be of the well-known tubular type comprised of two sections of equal length that fit together telescopically and are held together axially by an elastic cord (not shown). The leg sections may be metal, plastic or some other suitable material. Such support legs are described in greater detail in my previous U.S. Pat. No. 4,445,731 and are available commercially.

Figure 4:
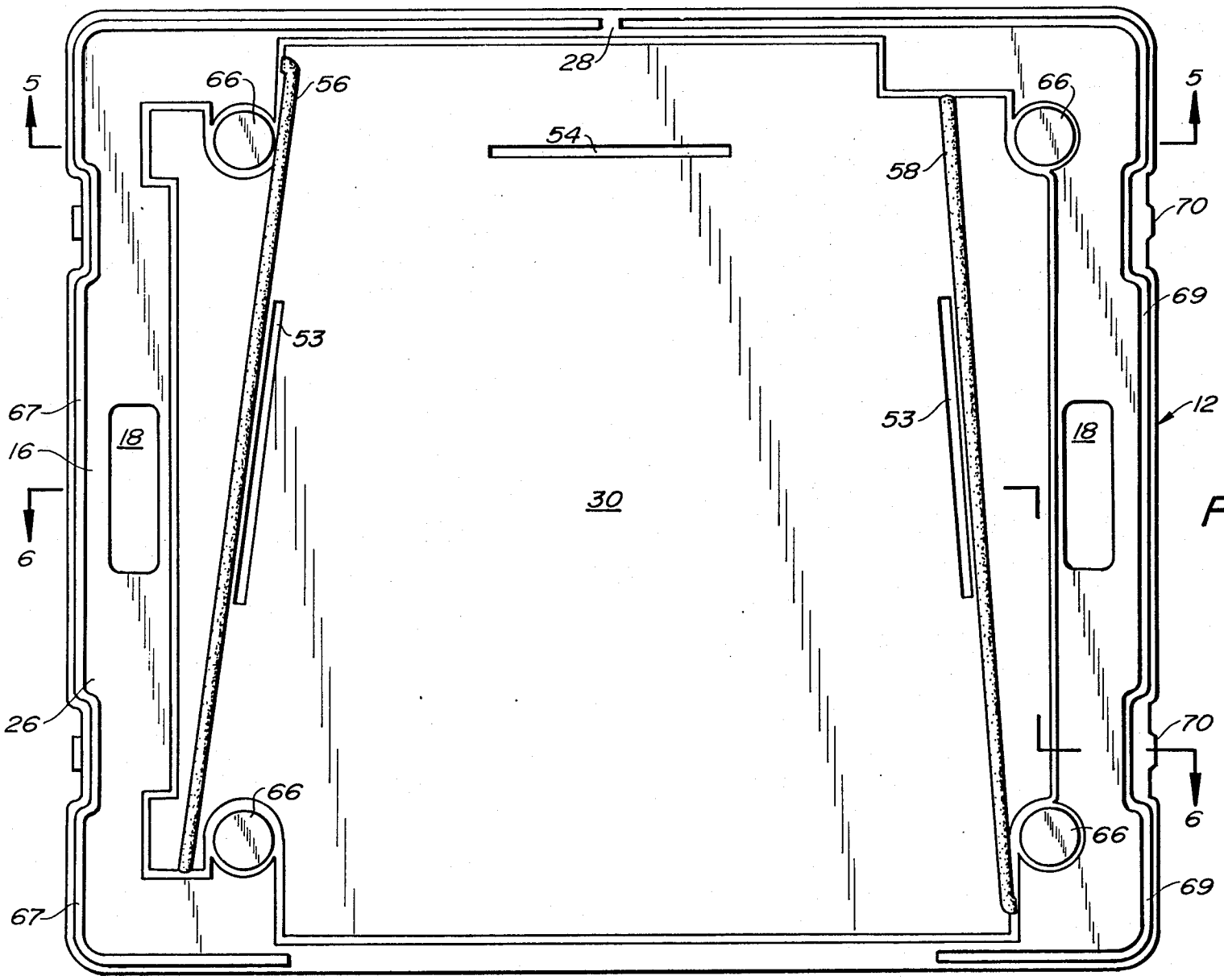
FIG. 4 is a top plan view of one voting booth base member according to the present invention.

The privacy shield 36 is preferably made of a semi-rigid sheet material such as fluted paper or sheet plastic board and has two side panels 38, 40 and an intervening central panel 42 all connected together by folded or hinged joints 44 and 46. On the bottom edge of each of the side panels 38 and 40 is an integral tab portion 48. A similar tab portion 50 is provided on the bottom edge of the central panel. The tab portions 48 are adapted to fit within a pair of side slots 53 and an intermediate slot 54 provided at preselected locations on the central portion of a base member 12, as shown in FIG. 4. Spaced above the tab member 48 on each side panel 38, the material is cut to form an arcuate shaped tab 55 that can be pushed outwardly. In a modified form, the slots 53 and 54 could be lengthened and joined together to provide one continuous U-shaped groove for receiving and retaining the bottom edge of the shield 36.

When the support legs 34 and privacy shield 36 for each base member 12 is stored in its recess 32, as shown in FIG. 2, these components are held in place by a pair of elastomeric bungee cords 56 and 58. Each of these cords is anchored by suitable means at their opposite ends near the opposite ends of side wall portions of the base member. The end anchor points for these bungee cords are located so that the cords extend across a substantial portion of the central portion 30 of each base member. Thus, when the support legs 34 and privacy shield 36 are stored in the recessed area of each base member, the bungee cords 56 and 58 are situated to extend across the ends of the support legs and privacy shield to hold them in place.

Figure 5:
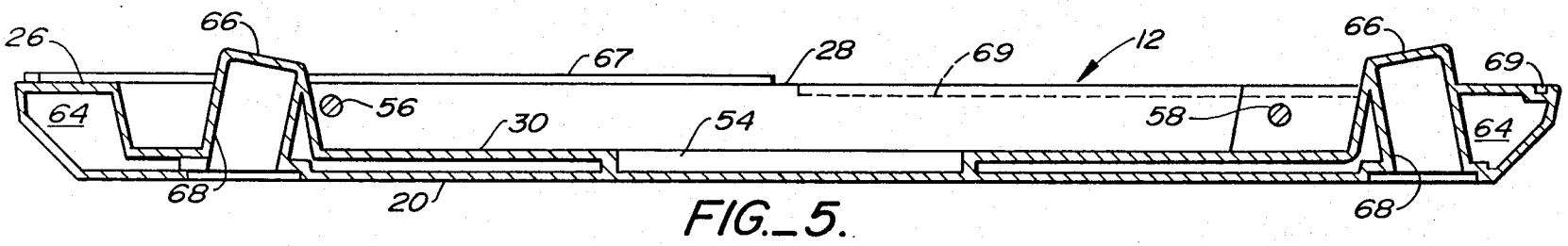
FIG. 5 is a view in section taken along line 5—5 of FIG. 4.
Figure 6:
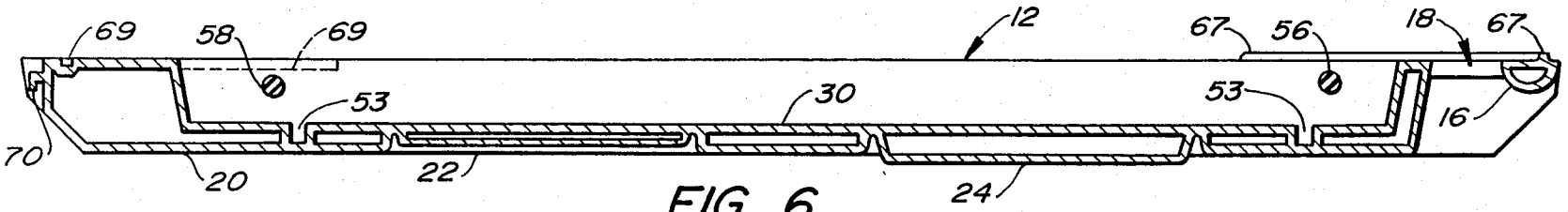
FIG. 6 is a view in section taken along line 6—6 of FIG. 4.

Turning to FIG. 4 and the accompanying sectional view of FIGS. 5 and 6, it is seen that in the embodiment shown, the base member 12 for each voting booth is a double walled structure which is made from a plastic material such as polyethylene using a suitable blow-mold process that is well known in the plastic molding field. Thus, as shown the base member essentially is comprised of two relatively thin walls 60 and 62 which merge at certain locations to form the desired contours and internal cavities 64 between the walls. Such a structure, so formed, can be rigid, strong, and yet relatively light in weight, and using the aforesaid molding process, the base members 12 can be made in quantity at a reasonable, relatively low unit cost. As shown in FIGS. 4 and 5, the side wall portions 26 are somewhat wider than the end wall portions 28. Spaced inwardly from each of the four corners of the base member is a boss-like hollow receptacle 66 forming a cylindrical socket 68 for receiving one end of a support leg 34. The axis for each cylindrical pocket is inclined upwardly and inwardly towards the center of its base member so that the lower ends of the legs will be spread apart when installed to provide increased stability.

In accordance with the invention, the base members 12 are preferably made from a single mold and when two base members are used to form the package 10 for carrying and storage purposes, one base member is turned over and reversed end-to-end to face with a mating base member. To assure that the two base members will become and stay precisely in register with each other, a groove 67 is formed in the upper surface of one side wall portion 26 and a raised bead 69 of the same length and shape is formed in the upper surface of the other side wall portion, as shown in FIG. 4. These mating groove and bead members which may extend partially around the end wall members 28, are also shown in FIGS. 5 and 6.

Figure 7:
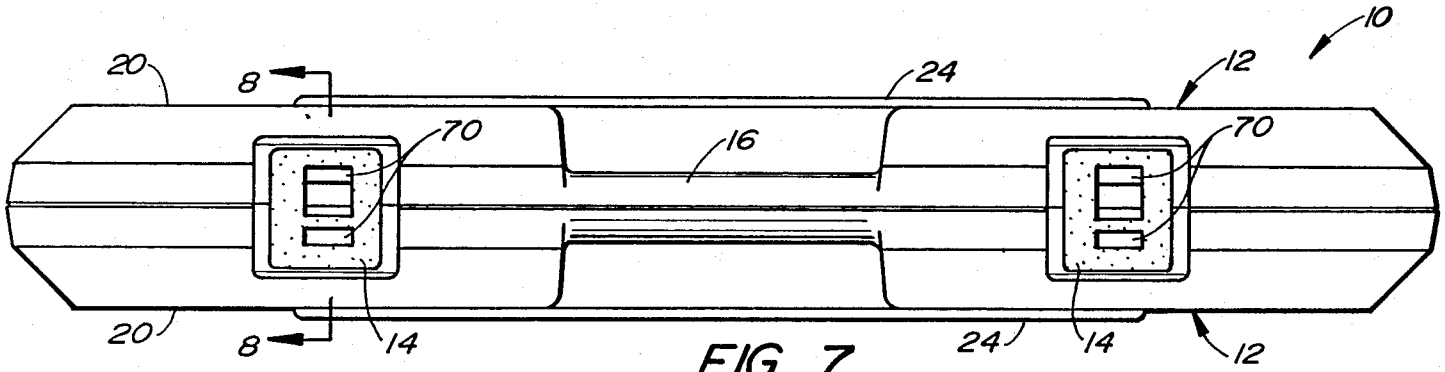
FIG. 7 a side view in elevation of a pair of voting booth base members connected together to form the carrying package 1.
Figure 8:
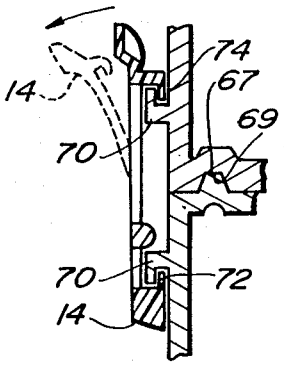
FIG. 8 is a view in section taken line 8—8 of FIG. 7 to show details of a retaining clip.

As mentioned previously the two base members 12 forming a package 10, while retaining the other components for storage, are held together by a series of four retaining clips 14. As shown in greater detail in FIGS. 7 and 8, each clip is retained by a lip type projection 70 located within each of two recesses 72 on the opposite side walls 26 of each base member. The clip 14, which is preferably molded in one piece from an elastomeric material, has a pair of upper and lower transverse locking members 74 and 76 at its opposite upper and lower ends. The lower locking bar member 74 of each clip is retained by an interference fit under one side projection 70 on the base member. When the two base members are in register together, each clip can be bent slightly, as shown in FIG. 8, so that its upper locking bar member 76 can be pushed over and into locking contact with the projection 70 on the upper base member. Once snapped into place, the four clip members will hold the two base members firmly together. However, when it becomes necessary to separate the base members to set up two voting booths, the upper locking bar for each clip is easily disconnected from its engaged projection and is bent back. Thus, the upper base member can be easily released and the clips 14 can be retained on the bottom base member. If desired, the clips 14 could be made or molded as part of one base member. However, replacement and repair of the clips is more easily provided if they are separate removable components.

The package 10 comprised of two self-contained voting booths is relatively light and easily carried by either of its side handles 16. When it is desired to assemble the voting booths, the process for doing so can be accomplished quickly and easily with minimal labor and no tools. As described above, the four retaining clips 14 are first disconnected at one end from one base member which is merely lifted off of the lower one. The two-piece support legs 34 are then removed from under the bungee cords and connected together in their extended mode. The upper end of each support leg is now inserted into a retaining socket 68 which is open on the underside of the base member 12. With the base member supported on its four legs, the primary shield 36 is now placed in position with its tabs 48 and 50 inserted into the appropriate receiving slots 53 and 54. Once in place, the bungee cords 56 and 58 on each side of the shield 36 is placed within the notches provided by the arcuate slots 55 on a side panel, thereby holding the shield 36 in place on the base member. The voting booth is now ready for use. For storage, the aforesaid erection process can be reversed with equal speed and efficiency, and a plurality of packages 10 each providing components for two disassembled voting booths can be stacked and nested within a minimum of space and with stability, as previously described.

Although the base member 12 has been shown and described as a double walled blow molded structure, it could also be molded as a solid structure using various plastic materials such as expand polystyrene styrofoam. A more permanent booth embodiment utilizing the principle of the invention could be injection molded of engineered plastic, or vacuum formed or blow molded, or cast of various other plastic materials or metals. In any case, according to the invention a single mold can be utilized to form both base members 12 of a package 10, by merely inverting and rotating 180° alternate mates from the mold.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. A portable dual voting booth assembly comprising:

a pair of generally rectangular base members, each in the form of a molded one-piece structure having side wall and end wall portions surrounding a central recessed portion and including means for forming four open receptacles near its four corners, said base members being connected together to form an enclosure;

a plurality of separable support legs sized at one end to fit within said open receptacles;

a pair of foldable privacy shields having a plurality of panels and adapted to be supported in an upright position on said central portion; and means attached to said base member for holding said support legs within said central recessed portion of at least one of said base members when said assembly is in storage and for holding each said privacy shield in its upright position on a base member when said assembly is erected for use.

2. The voting booth assembly as described in claim 1 wherein said means for holding comprises:

a pair of bungee cords, each connected at their opposite ends to said base member and extending at least partially across said central portion thereof, said cords being adapted to retain said support legs on said base member when they are separated and stowed for storage and also for holding said privacy shield in place on said central portion when said voting booth is set up for use.

3. The dual voting booth package as described in claim 1 wherein said pair of base members are identical in size and shape.

4. The dual voting booth package as described in claim 3 including register means in said peripheral wall portion which assures alignment of a pair of said base members when one said base member is turned over to face another said base member to form said storage space between the pair of adjoining base members.

5. The dual voting booth package as described in claim 4 wherein said register means comprises a bead member located along one side of each said base member and a matching groove of the same size and shape as said bead member located no the opposite side of said each base member.

6. The dual voting booth as described in claim 1 wherein each said base member is blow molded as a double walled structure from plastic material.

7. The dual voting booth package as described in claim 6 wherein said handle means comprise a grip bar adjacent an opening provided on opposite side edges of the peripheral wall position for each said base member.

8. The dual voting booth as described in claim 1 wherein each said base member is generally rectangular in shape and has integral handle means on at least one outer side of said peripheral wall portion.

9. The dual voting booth package as described in claim 1 wherein an outer surface of said transverse portion on each said base member has a pair of stacking members of the same shape, one of said stacking members projecting outwardly a uniform distance from said outer surface and the other said stacking member being recessed inwardly substantially the same uniform distance.

10. The dual voting booth package as described in claim 1 wherein said retaining means comprises an extended lip member at each of a plurality of pre-selected locations on the outer edge of said peripheral wall portion, said lip members being in vertically aligned pairs when two said base members are placed together to form said package, and removable clip means for engaging the pairs of aligned lip means for holding said base m embers together.

11. The dual voting booth package as described in claim 10 wherein each said clip means is formed from a bendable elastomeric material and has a pair of spaced apart transverse members near its opposite ends for engaging said lip means of an aligned pair of base members.

12. A portable, dual voting booth package providing components for erecting two voting booths, said package comprising:

a pair of base members, each having a peripheral wall portion connected to a central transverse portion forming a recessed area;

retaining means for holding said base members together along their said wall portions so that said recessed areas form an enclosed storage space for other voting booth components;

a plurality of leg supports and a pair of privacy shields retained entirely within said storage space of said base members when they are held together, said leg supports and said privacy shields being attachable to said base members to form two separate voting booths.

13. The dual voting booth package as described in claim 12 including flexible means on each said base member for holding one set of leg supports and on said privacy shield in place with the recess of said base member and also for holding said privacy shield in place on its base member when the voting booth is erected.

14. The dual voting booth package as described in claim 12 wherein said flexible means comprises a pair of bungee cords anchor at their ends to opposite sides of each said base member and extending at least partially across its recessed area.

* * * * *